United States Patent [19]

Bennett et al.

[11] 4,037,569

[45] July 26, 1977

[54] FLOW DISTRIBUTION ARRANGEMENT FOR A STEAM GENERATOR

[75] Inventors: Robert R. Bennett, Clearwater; Wilbur M. Byerley, Riverview, both of Fla.

[73] Assignee: Westinghouse Electric Corporation, Pittsburgh, Pa.

[21] Appl. No.: 653,988

[22] Filed: Jan. 30, 1976

[51] Int. Cl.[2] ..... F22B 1/06; F22B 37/48

[52] U.S. Cl. ..... 122/32; 122/383; 122/451 R

[58] Field of Search ..... 122/32, 33, 34, 382, 122/381, 383, 451

[56] References Cited

U.S. PATENT DOCUMENTS

| | | | |
|---|---|---|---|
| 3,913,531 | 10/1975 | von Hollen | 122/382 |
| 3,915,122 | 10/1975 | Schroder | 122/32 |
| 3,916,844 | 11/1975 | Cassell | 122/382 |
| 3,942,481 | 3/1976 | Bennett | 122/32 |

*Primary Examiner*—Kenneth W. Sprague
*Attorney, Agent, or Firm*—F. J. Baehr, Jr.

[57] ABSTRACT

Blocks are disposed in notches in a wrapper encircling a tube bundle of a steam generator, covers are disposed over a plurality of holes in blowdown pipes; the ports in the feedwater header are arranged to improve the flow of feedwater and recirculation water over the tube sheet of the steam generator.

10 Claims, 4 Drawing Figures

FLOW DISTRIBUTION ARRANGEMENT FOR A STEAM GENERATOR

BACKGROUND OF THE INVENTION

This invention relates to steam generators and more particularly to modifications to the feedwater distribution system to improve the lateral velocity of the secondary side water adjacent the tube sheet.

A review of steam generator operation and pressurized water nuclear reactors indicates that most of the tube defects have appeared in a region of the steam generator where the flow velocities are lowest and consequently sludge has accumulated. To reduce the accumulation of sludge it is desirable to increase the flow across the tubesheet and particularly in those areas where experience has shown sludge accumulates, the area toward the center of the hotleg and coldleg.

SUMMARY OF THE INVENTION

In general, a steam generator, when made in accordance with this invention, comprises a vertically oriented shell, a plurality of U-shaped tubes disposed in the shell so as to form a tube bundle having an open lane adjacent the tubes having the shortest radius bends, a head portion having a tubesheet with holes for receiving the tubes and a dividing plate which cooperates to form headers for each end of the U-shaped tubes, a primary fluid inlet nozzle in fluid communication with one of the headers and a primary fluid outlet nozzle in fluid communication with the other header, whereby the primary fluid flows through the tubes forming a hotleg and a coldleg portion of the tube bundle. The steam generator also comprises a wrapper disposed between the tube bundle and the shell to form an annular chamber adjacent the shell, and a feedwater inlet ring disposed to introduce influent feedwater to the upper portion of the annular chamber. The feedwater inlet ring has ports so disposed that the majority of the feedwater is introduced into that portion of the annular chamber adjacent the hotleg portion of the tube bundle. The feedwater inlet ring also has its ports so disposed that no feedwater is introduced to that portion of the annular chamber adjacent the open lanes. The annular chamber is generally free of obstructions, whereby the flow distribution of feedwater across the tubesheet is improved.

BRIEF DESCRIPTION OF THE DRAWINGS

The objects and advantages of this invention will become more apparent from reading the following description in connection with the accompanying drawings in which.

DESCRIPTION OF THE PREFERRED EMBODIMENTS

Figure 1:
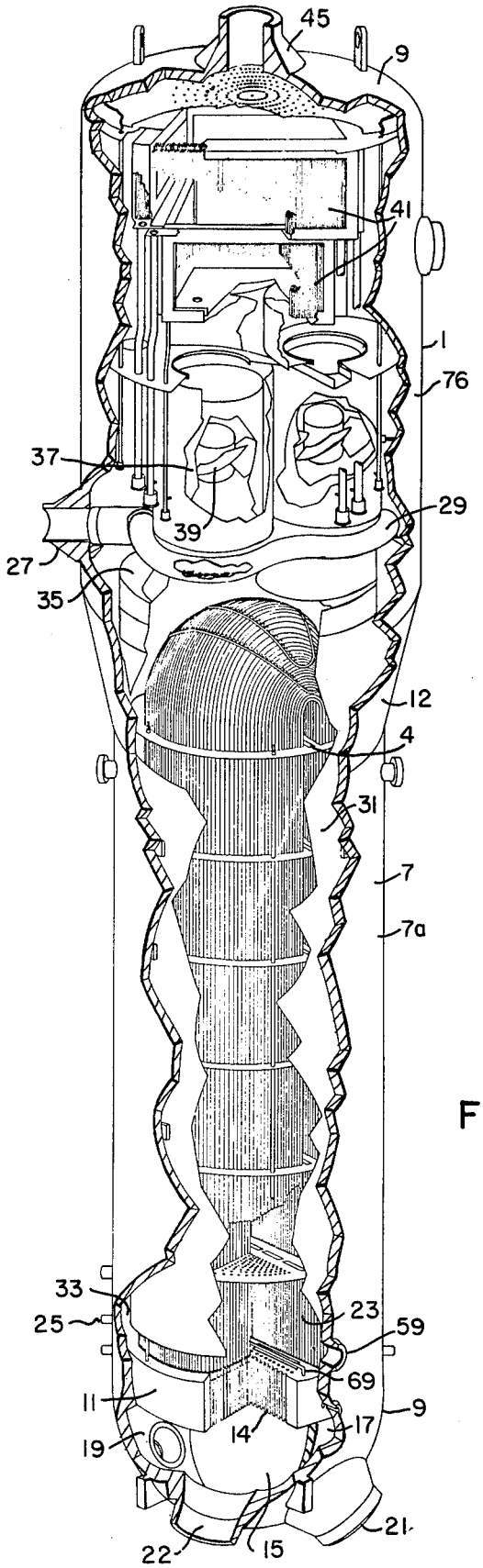
FIG. 1 is a perspective partial sectional view of a steam generator made in accordance with this invention.

Referring now to the drawings in detail, FIG. 1 shows a steam or vapor generator 1, which utilizes a bundle of U-shaped tubes 3 to provide the heating surface required to transfer heat from a primary fluid to vaporize or boil a secondary fluid. The tubes 3 are disposed in rows so that there is an open lane 4 in the center of the tube bundle adjacent the tubes having the smallest radius bends. The steam generator 1 comprises a vessel having a vertically oriented tubular shell portion 7 and an end closure or flanged and dished head 9 enclosing one end of the shell 7, the upper end, and a spherically shaped channel head 11 enclosing the other end of the shell, the lower end. The lower portion of the shell **7*a* is smaller in diameter than the upper portion 7*b* and a frusto-conical shaped transition member 12** connects the upper and lower portions.

A tube sheet 13 is made integral with the channel head 11 and has plurality of holes 14 disposed therein for receiving the ends of the U-shaped tubes 3. A dividing plate 15 is centrally disposed in the channel head 11 to divide the channel head into compartments 17 and 19, which serve as headers for the tubes. The compartment on the right, as shown in FIG. 1, is the primary fluid inlet compartment 17 and has a primary fluid inlet nozzle 21 in fluid communication therewith. The compartment on the left, as shown in FIG. 1, is the primary fluid outlet compartment and has a primary fluid outlet nozzle 22 disposed in fluid communication therewith. Thus the primary inlet fluid flows through the tubes creating a hotleg portion 23, the portion shown on the right in drawings, and a coldleg portion 25, the portion shown on the left in the drawings. A secondary fluid or feedwater inlet nozzle 27 is disposed in the upper portion **7*b* of the shell 7 above the tube bundle and has a ring header 29** in fluid communication therewith.

The tube bundle is encircled by a wrapper 31 which extends the length of the tube bundle and forms an annular chamber 33 between the wrapper 31 and the shell 7. The wrapper 31 has an upper cover or head 35 disposed above the bends of the tubes 3. The head 35 has a plurality of openings in communication with sleeves 37 which have swirl vanes 39 disposed therein to cause the steam flowing therethrough to spin and centrifugally remove some of the moisture contained therein as it flows through the sleeves 37. After flowing through the sleeves 37 the steam then passes through a chevron type separator 41 before reaching a secondary fluid outlet nozzle 45, centrally disposed in the flanged and dished head 9.

Figure 2:
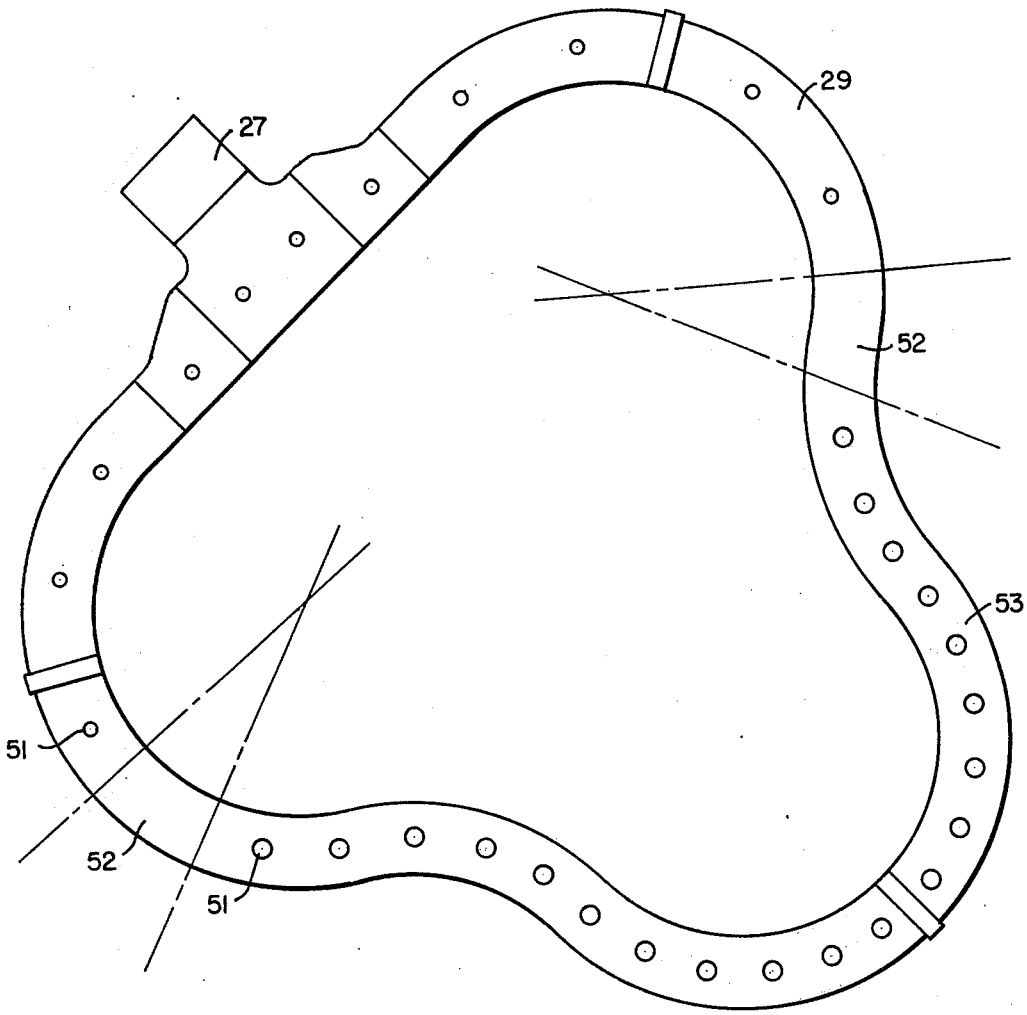
FIG. 2 is an enlarged plan view of a feedwater distribution ring made in accordance with this invention.

The ring header 29, as shown in FIG. 2, comprises three loops forming a generally cloverleaf-shaped ring. The inlet nozzle 27 joins the ring header 29 and forms a "T" therewith. The ring header 29 has a plurality of discharge ports 51 disposed therein. The ports 51 are arranged in different arrays in various portions of the ring. Portions 52 on opposite sides of the ring 29 adjacent that portion of the annular chamber 33 which is adjacent the open lanes are imperforate or without ports, a portion 53 which is disposed adjacent that portion of the annular chamber 33, which is adjacent the hotleg portion 23 of the tube bundle has ports 51 which provides the majority of the feedwater flow to the steam generator by providing larger ports or a greater number of ports or both than a portion 55, adjacent that portion of the annular chamber 33 adjacent the coldleg 25, whereby feedwater tends to flow at a higher rate down that portion of the annular chamber 33 adjacent the hotleg 23 to improve the flow distribution of feedwater and recirculating water across the tube sheet 13. The annular chamber 33 is also free of obstructions to assist and improve the flow distribution across the tubesheet 13.

Figure 3:
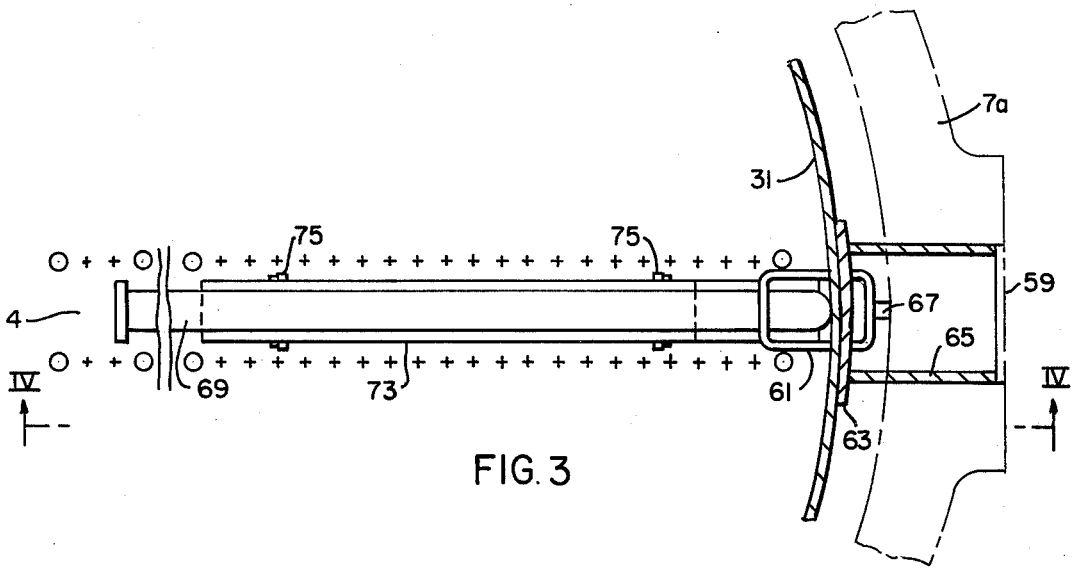
FIG. 3 is an enlarged plan view of a blowdown pipe, cover and tube lane block made in accordance with this invention.
Figure 4:
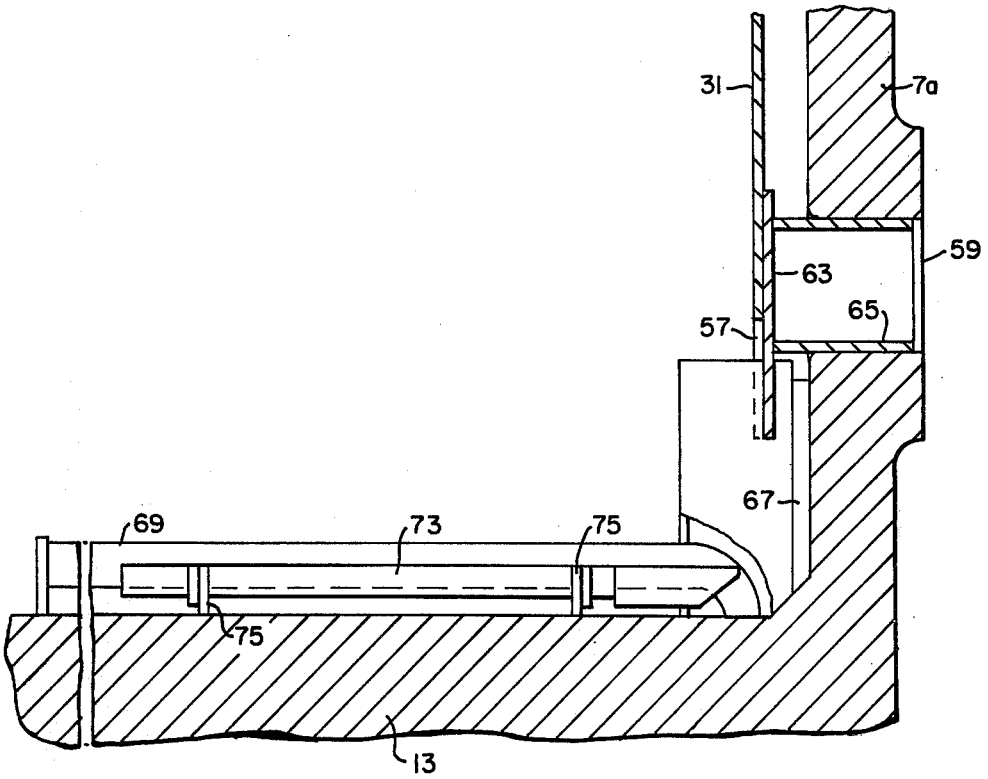
FIG. 4 is an enlarged evaluation view taken on lines IV—IV of FIG. 3.

As shown in FIGS. 3 and 4, the wrapper 31 has diametrically opposed notches or openings 57 disposed at the lower end thereof adjacent the open lane 4 and handholes 59 are disposed in the shell 7 adjacent the notches 57. Tube lane or open lane blocks 61, which fit through the handholes 59, are cooperatively associated with cover plates 63, sleeves 65 and shims 67 to form notch blocking means which can be inserted through the handhole 59 and securely fixed between the wrapper 31 and the shell 7 to block the flow of feedwater to the open lane 4 in order to improve the flow distribution of feedwater across the tubesheet 13.

As shown in FIGS. 1, 3 and 4, blowdown pipes 69 are disposed in the open lane 4 adjacent the tubesheet 13 and extend radially inwardly from adjacent the edges of the tube bundle. The blowdown pipes 69 have a plurality of openings 71, which are disposed in a space relationship along the lower portion thereof. A troughlike cover 73 has legs 75 that allow the cover to pass through the handhole 59 and position the covers 73 so that they abut the lower portion of the blowdown pipes 69 in order to block off openings near the outer portion of the tube bundle, whereby blowdown is only drawn from the central portion of the tube bundle to improve the flow distribution of feedwater and recirculated water across the tubesheet 13.

The open lane blocks 61 are cooperatively associated with the troughlike covers 73 to lock the covers 73 in place.

The distribution of feedwater from the feedwater ring, the blocked notches adjacent the open lane 4 and the blowdown pipe covers 73 cooperate to move the minimum lateral velocity of secondary water adjacent the tubesheet to a small semicircular area in the hotleg portion of the tube bundle adjacent the open lane 4 to generally improve the flow distribution across the tubesheet and facilitate blowdown of solids from the steam generator in order to reduce attack on the tube walls due to the accumulation of sludge.

What is claimed is:

1. A vapor generator in which heat is transferred from a primary to a sencondary fluid to vaporize the latter, said vapor generator comprising:

a vertically oriented shell, a plurality of U-shaped tubes disposed in said shell so as to form a tube bundle having an open lane adjacent the tubes having the shortest radius bends, a head portion having a tubesheet with holes for receiving said tubes and a dividing plate which cooperates to form headers for each end of the U-shaped tubes, a primary fluid inlet nozzle in fluid communication with one header, a primary fluid outlet nozzle in fluid communication with the other header, whereby the primary fluid flows through the tubes forming a hotleg and a coldleg portion of the tube bundle, a wrapper disposed between the tube bundle and the shell to form an annular chamber adjacent the shell, a secondary fluid inlet ring disposed to introduce influent secondary fluid to the upper portion of the annular chamber, said secondary fluid inlet ring having ports so disposed therein that the majority of the secondary fluid is introduced into that portion of the annular chamber adjacent the hotleg portion of the tube bundle, said secondary fluid ring having said ports so disposed that no secondary fluid is introduced to that portion of the annular chamber adjacent the said open lanes, said annular chamber being generally free from obstructions, whereby the flow distribution of secondary fluid across the tubesheet is improved.

2. The vapor generator as set forth in claim 1, wherein the secondary fluid inlet ring has substantially more ports adjacent that portion of the annular chamber adjacent the hotleg portion of the tube bundle than it does adjacent that portion of the annular chamber adjacent the coldleg portion of the tube bundle.

3. The vapor generator as set forth in claim 2, wherein the secondary fluid inlet ring has substantially larger ports adjacent that portion of the annular chamber adjacent the hotleg portion of the tube bundle than it does adjacent that portion of the annular chamber adjacent the coldleg portion of the tube bundle.

4. The vapor generator as set forth in claim 1, wherein the secondary fluid inlet ring has substantially larger ports adjacent that portion of the annular chamber adjacent the hotleg portion of the tube bundle than it does adjacent that portion of the annular chamber adjacent the coldleg portion of the tube bundle.

5. The vapor generator as set forth in claim 1, wherein the wrapper has an opening in the lower margin, said opening being disposed adjacent the open lane and the vapor generator further comprises blocking means disposed to cover said opening.

6. The vapor generator as set forth in claim 5, and further comprising a blowdown pipe disposed in the open lane adjacent the tubesheet so as to extend radially inwardly from adjacent the outer edge of the tube bundle toward the center thereof, said blowdown pipe having a plurality of openings spaced along the lower portion thereof and means for covering a plurality of the holes adjacent the outer edge of the tube bundle, whereby blowdown is drawn from the central portion of the tube bundle.

7. The steam generator as set forth in claim 5, and further comprising a handhole adjacent said tubesheet and the open lane, the blocking means fitting through the handhole.

8. The steam generator as set forth in claim 6, and further comprising a handhole adjacent the tubesheet and the open lane, the blocking means fitting through the handhole.

9. The steam generator as set forth in claim 8, wherein the covering means fits through the handhole.

10. The steam generator as set forth in claim 9, wherein the covering means and the blocking means are locked in position within the shell.

* * * * *